US009028029B2

(12) United States Patent
Azuma et al.

(10) Patent No.: US 9,028,029 B2
(45) Date of Patent: May 12, 2015

(54) INKJET PRINTING METHOD

(71) Applicant: Canon Kabushiki Kaisha, Tokyo (JP)

(72) Inventors: Satoshi Azuma, Kawasaki (JP); Shigeyasu Nagoshi, Yokohama (JP); Minoru Teshigawara, Saitama (JP); Yoshiaki Murayama, Tokyo (JP); Susumu Hirosawa, Tokyo (JP); Yutaka Kano, Yokohama (JP); Takeshi Murase, Yokohama (JP); Kentarou Muro, Tokyo (JP); Masao Kato, Kawasaki (JP); Minako Kato, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/272,722

(22) Filed: May 8, 2014

(65) Prior Publication Data

US 2014/0247307 A1 Sep. 4, 2014

Related U.S. Application Data

(62) Division of application No. 12/963,660, filed on Dec. 9, 2010, now Pat. No. 8,757,754.

(30) Foreign Application Priority Data

May 6, 2010 (JP) ..... 2010-106618

(51) Int. Cl.

| | |
|---|---|
| ***B41J 29/38*** | (2006.01) |
| ***B41J 11/00*** | (2006.01) |
| ***B41J 2/165*** | (2006.01) |
| ***B41J 2/17*** | (2006.01) |

(52) U.S. Cl.

CPC ..... *B41J 11/0015* (2013.01); *B41J 2/165* (2013.01); *B41J 2/16552* (2013.01); *B41J 2/1714* (2013.01)

(58) Field of Classification Search

None

See application file for complete search history.

(56) References Cited

U.S. PATENT DOCUMENTS

| | | | |
|---|---|---|---|
| 5,055,861 | A | 10/1991 | Murayama et al. |
| 5,136,307 | A | 8/1992 | Uchida et al. |
| 5,477,248 | A | 12/1995 | Sugimoto et al. |
| 8,444,246 | B2 | 5/2013 | Muro et al. |
| 8,622,538 | B2 | 1/2014 | Miyakoshi et al. |
| 2006/0109300 | A1 | 5/2006 | Tsuboi et al. |
| 2007/0285456 | A1 | 12/2007 | Takasu et al. |
| 2010/0079515 | A1 | 4/2010 | Kuwahara et al. |

FOREIGN PATENT DOCUMENTS

| | | | |
|---|---|---|---|
| JP | 2000-255053 | A | 9/2000 |
| JP | 2004-181890 | A | 7/2004 |
| JP | 2005-028741 | A | 2/2005 |
| JP | 2006-044021 | A | 2/2006 |
| JP | 2006-315192 | A | 11/2006 |
| JP | 2007-313666 | A | 12/2007 |

OTHER PUBLICATIONS

Office Action issued in Japanese Patent Application No. 2010-106618, dated Nov. 11, 2014.

Office Action issued in Japanese Patent Application No. 2010-106618 dated Jan. 7, 2014.

*Primary Examiner* — Geoffrey Mruk

*Assistant Examiner* — Bradley Thies

(74) *Attorney, Agent, or Firm* — Fitzpatrick, Cella, Harper & Scinto

(57) ABSTRACT

A printing method is performed on a plurality of inkjet print heads to which humidified air is supplied to retain the humidity in the print heads. Ink colors for the plurality of heads are arranged in a sequence corresponding to ink characteristics. The plurality of print heads is divided into groups, with one of the groups being subjected to preliminary ejection on a sheet. The other print head group not subjected to preliminary ejection is located in a more upstream area with respect to a conveyance direction of the sheet.

7 Claims, 6 Drawing Sheets

| REFERENCE NUMERAL | RECEPTION BUFFER | SHEET-SURFACE PRELIMINARY EJECTION |
|---|---|---|
| 1a | Bk,BLACK | NOT PERFORMED |
| 1b | M,MAGENTA | NOT PERFORMED |
| 1c | C,CYAN | NOT PERFORMED |
| 1d | LC,LIGHT CYAN | PERFORMED |
| 1e | LM,LIGHT MAGENTA | PERFORMED |
| 1f | Y,YELLOW | PERFORMED |
| 1g | Gy,GRAY | PERFORMED |

| REFERENCE NUMERAL | RECEPTION BUFFER |
|---|---|
| 1a | Bk,BLACK |
| 1b | M,MAGENTA |
| 1c | C,CYAN |
| 1d | LC,LIGHT CYAN |
| 1e | LM,LIGHT MAGENTA |
| 1f | Y,YELLOW |
| 1g | Gy,GRAY |

FIG.3

| REFERENCE NUMERAL | RECEPTION BUFFER |
|---|---|
| 1a | Gy,GRAY |
| 1b | LC,LIGHT CYAN |
| 1c | LM,LIGHT MAGENTA |
| 1d | C,CYAN |
| 1e | M,MAGENTA |
| 1f | Y,YELLOW |
| 1g | Bk,BLACK |

FIG.5

| REFERENCE NUMERAL | RECEPTION BUFFER | SHEET-SURFACE PRELIMINARY EJECTION |
|---|---|---|
| 1a | Bk,BLACK | NOT PERFORMED |
| 1b | M,MAGENTA | NOT PERFORMED |
| 1c | C,CYAN | NOT PERFORMED |
| 1d | LC,LIGHT CYAN | PERFORMED |
| 1e | LM,LIGHT MAGENTA | PERFORMED |
| 1f | Y,YELLOW | PERFORMED |
| 1g | Gy,GRAY | PERFORMED |

FIG.6

INKJET PRINTING METHOD

This application is a divisional of U.S. patent application Ser. No. 12/963,660, filed Dec. 9, 2010.

BACKGROUND OF THE INVENTION

1. Field of the Invention

The present invention relates to an inkjet printing apparatus and an inkjet printing method both capable of suppressing drying of ink in an inkjet print head.

2. Description of the Related Art

Japanese Patent Laid-Open No . 2000-255053 discloses a technique used for a printer in which a plurality of inkjet print heads are arranged in a sheet conveyance direction, to feed humidified gas from an upstream side to the vicinity of nozzles in the print head to retain the humidity in the print head, thus suppressing drying of ink.

A sheet formed of a material such as paper has equilibrium moisture corresponding to humidity (the state in which the moisture in the sheet no longer changes). The sheet absorbs the moisture in the air when the humidity is high, and releases the moisture contained in the sheet when the humidity is low. When the sheet is fed to the vicinity of the print head with the humidity thereof increased by the fed humidified air, the sheet absorbs the moisture.

Thus, the humidity of the atmosphere may decease to prevent the humidity in the print head from being properly retained. In particular, if the print head includes a plurality of print heads arranged along a direction in which the humidified air is introduced, a long time is required for the humidified gas fed from the upstream side to reach a downstream side. In the meantime, when the sheet absorbs the moisture, downstream print heads are likely to fail to sufficiently retain humidity. The insufficient humidity retention may cause improper ink ejection or the like and thus degraded image quality.

SUMMARY OF THE INVENTION

The present invention is based on the recognition of the above-described problems. An object of the present invention is to provide a printing apparatus and a printing method in both of which a plurality of print heads are arranged in a proper sequence in connection with humidity retention to allow suppression of degradation of image quality resulting from improper ink ejection or the like.

The present invention provides an inkjet printing apparatus according to the present invention includes:

a printing unit including a plurality of print heads of an inkjet type each having nozzles, the print heads being arranged along a direction in which a sheet is conveyed; and a humidification unit configured to feed humidified air to a space in which the nozzles of the print heads are exposed, part of the humidified air fed to the space flowing along the direction between the sheet and the nozzles of the print heads, wherein the print heads are arranged in such a manner that a print head configured to eject ink characterized by having a larger amount of volatile components evaporated within a predetermined time is located in a more upstream area.

According to the present invention, the plurality of print heads are arranged in a proper sequence in connection with humidity retention to properly retain humidity, thus allowing suppression of degradation of image quality resulting from improper ink ejection or the like, without the need to increase the size and complexity of the apparatus.

Further features of the present invention will become apparent from the following description of exemplary embodiments (with reference to the attached drawings).

BRIEF DESCRIPTION OF THE DRAWINGS

FIG. 3 is a diagram showing the sequence of ink for print heads;

FIG. 5 is a diagram showing the sequence of the ink for the print heads; and FIG. 6 is a diagram illustrating the sequence of the ink for the print heads.

DESCRIPTION OF THE EMBODIMENTS

First Embodiment

Figure 1:
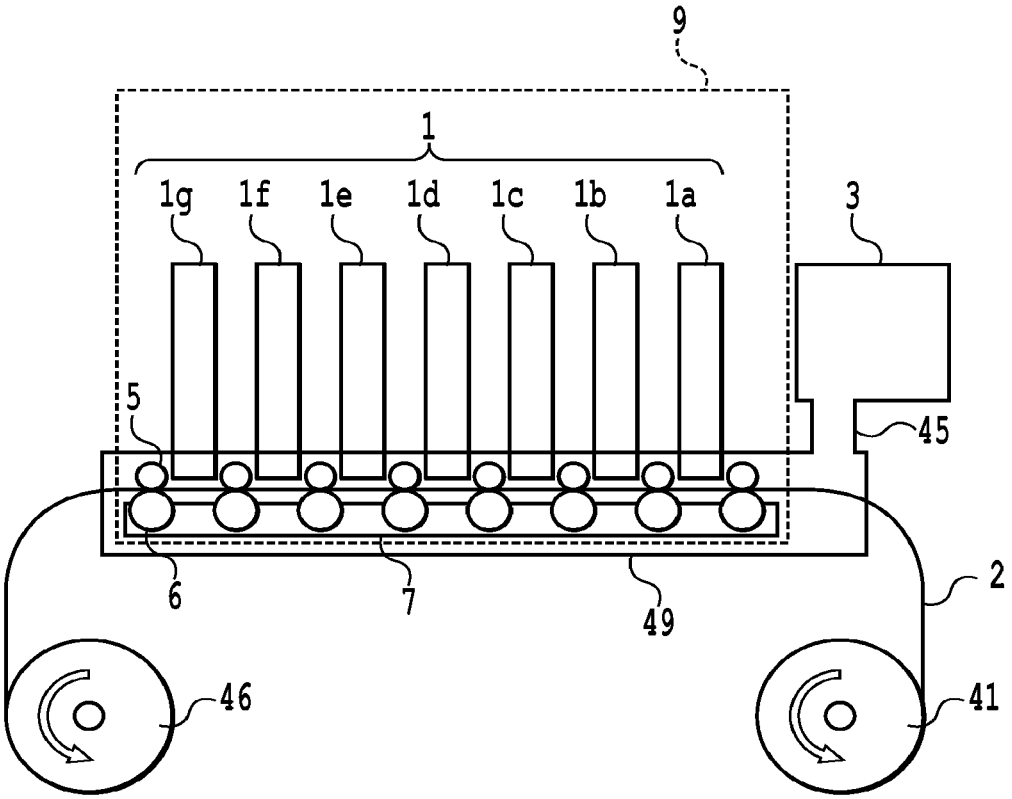
FIG. 1 is a diagram of the configuration of an embodiment of an inkjet printing apparatus.

FIG. 1 is a diagram of an inkjet printing apparatus according to a first embodiment of the present invention. The present embodiment uses humidified air, but may use humidified gas other than air. In the present specification, "air" is a general term for air and gas other than air. Furthermore, the present specification uses the following definition. At any position in a sheet conveyance path, a direction toward to a sheet feeding side is "upstream", whereas the opposite direction is "downstream".

The printing apparatus in the present example is of what is called a roll to roll type. A feed roller 41 feeds a sheet 2 that is a rolled continuous sheet. A takeup roller 42 takes up the sheet printed by a printing unit 9, into roll form. The printing unit 9 includes a housing shown by a dotted line in FIG. 1 and a conveyance mechanism and a printing unit both provided inside the housing; the housing, the conveyance mechanism, and the printing unit are integrated into a unit. The conveyance mechanism includes a platen 7 configured to assist in supporting the sheet 2, and a plurality of roller pairs each including a driving roller 6 and a driven roller 5. The driving roller 6 is partly embedded in the platen 7 so as to be rotatable. The driving roller 6 is rotated by a driving source to convey the sheet. The driven roller 5 is located opposite the driving roller 6 across the sheet 2. A print head 1 forming a printing unit is provided between the driving roller 6 and driven roller 5 forming the roller pair.

The print head 1 is of a fixed, full line type including nozzles formed to cover the maximum print width in the width direction of the sheet 2. The inkjet scheme in the present example uses heating elements. However, the present invention is not limited to this configuration but is applicable to, for example, a scheme using piezoelectric elements, electrostatic elements, or MEMS elements. As many print heads 1*a* to 1*g* as the number of (in the present example, seven) colors are arranged along a sheet conveyance direction. The plurality of print heads are integrally held.

Each of the print heads is fed with ink from ink feeding device (not shown in the drawings) such as an ink tank. Each of the print heads 1 and an ink tank in which ink in the corresponding color is stored may be integrated into a unit. The printing unit 9 operates according to a line print scheme, and allows the print heads 1 for the respective colors to apply the ink in the respective colors to the sheet 2 to form an image. In the present example, roll paper is used as the sheet 2.

However, any type of sheet may be used, such as continuous paper folded at intervals of a unit length or cut paper.

Humidified air feeding device 3 (humidification unit) is provided to humidify a humidification area 49. The humidification area 49 is a narrow space in the printing unit 9 in which the nozzles in the print heads 1 are exposed. The humidified air feeding device 3 enables humidified air to be fed through a sheet introduction port (an upstream inlet of the humidification area 49) in the printing unit 9 to increase the atmosphere humidity of the narrow space in which the nozzles in the print heads 1 are exposed. This allows the humidity in the nozzles in the plurality of print heads to be retained to suppress drying. The humidified air feeding device 3 includes a humidifier, a blower, and an intake port. A feed duct is connected to the humidified air feeding device 3. The tip of the feeding duct forms a feed port 45 through which humidified air is injected. The feed port 45 is provided near the sheet introduction port to feed humidified air to the humidification area 49 through the feed port 45.

The humidified air fed by the second humidified air feeding device 3 flows through the humidification area 49 from upstream to downstream. Specifically, at the position of each print head 1, the humidified air passes through the gap (hereinafter referred to as the print gap) between the tip (the surface in which the nozzle is formed) of the print head 1 and the sheet 2. Furthermore, between the adjacent print heads 1, the humidified air passes through the gap formed between the sheet 2 and a holder configured to hold the print heads 1.

That is, the humidified air is transmitted to the downstream print heads 1 while passing through the two types of gaps. In the inkjet scheme, the print gap is normally as narrow as about 1 mm. When the humidified air passes through the print gap, the flow velocity of the humidified air increases. This may affect the accuracy at which during printing, ejection droplets (a main droplet and satellite droplets) ejected from the print heads 1 impact the sheet. Thus, the humidified air fed from the humidified air feeding device 3 desirably has a flow velocity set to at most 1 m/sec. at the print gap.

Figure 2:
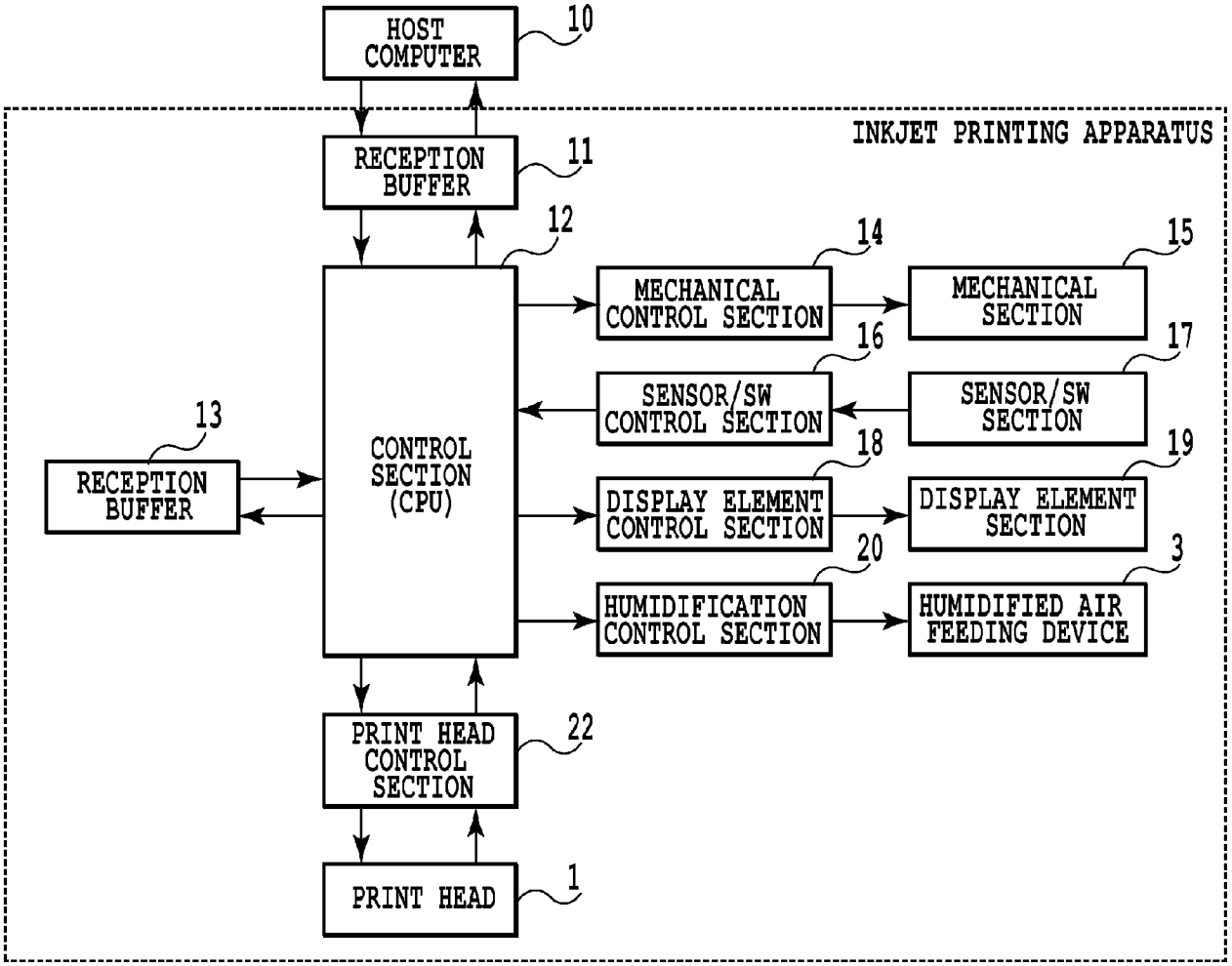
FIG. 2 is a block diagram of a control system.

FIG. 2 is a block diagram of a control system used for the above-described inkjet printing apparatus. Data such as characters and images to be printed is input from a host computer 10 to a reception buffer 11 in the inkjet printing apparatus. Furthermore, the following are output from the inkjet printing apparatus to the host computer 10: data indicating, for example, whether or not the data has been correctly transferred and data indicating the operational status of the inkjet printing apparatus. The data in the reception buffer 11 is transferred to a memory section 13 and temporarily stored in RAM under the control of a CPU 12.

A mechanical control section 14 drives a mechanical section 15 including a line head carriage, a cap, and a wiper in response to instructions from the CPU 12. A sensor/SW (SWitch) control section 16 transmits signals from a sensor/SW section 17 including various sensors and SWs (SWitches) to the CPU 12. A display element control section 18 controls a display element section 19 including LEDs, liquid crystal display elements, and the like in a display panel in response to instructions from the CPU 12. A humidification control section 20 controls the humidified air feeding device 3 in response to instructions from the CPU 12. In this case, the CPU 12 determines the amount of moisture fed to the print medium 2 based on various pieces of information, for example, an environmental temperature, the type and thickness of the print medium 2, the temperature of the line head, and the firing amount of image data to be printed. This allows humidification conditions to be set for the humidified air feeding section 21. A print head control section 22 controllably drives the print heads 1 in response to instructions from the CPU 12. The print head control section 22 further detects and communicates, for example, temperature information indicative of the condition of the print heads 1, to the CPU 12.

Now, the humidity condition for the humidified air fed from the humidified air feeding device 3 will be described. The atmosphere around the print head 1 needs to hinder ink from evaporating from the print heads 1. To hinder ink from evaporating from the print heads 1, it is ideal to set relative humidity to as close to 100% as possible. However, in this case, the following problem may result. That is, a slight change in temperature or humidity may immediately cause condensation. For example, it is difficult to constantly stabilize the temperature and humidity conditions for the humidified air fed from the humidified air feeding device 3 at a relative humidity of about 100%.

Moreover, condensation also occurs if the interior of the print unit 9 is locally cold. Thus, the humidified air fed from the humidified air feeding device 3 suitably has a relative humidity of about 60% to 70% if for example, the temperature of the ink is between 30° C. and 40° C. Hence, the humidified air feeding device 3 injects humidified air with a relative humidity of 60% to 70% to the humidification area 49.

The moisture in the humidified air fed by the humidified air feeding device 3 is partly absorbed by the print medium 2 conveyed by the conveyance mechanism before spreading to every part of the humidification area 49. This absorption phenomenon lasts until the print medium 2 reaches the equilibrium moisture corresponding to the humidity of the humidification area 49. Because of the humidification phenomenon, for example, immediately below the upstream head 1*a* in the humidification area 49, a high-humidity atmosphere with a relative humidity of 60% to 70% is maintained. Immediately below the downstream head 1*f*, the relative humidity is reduced down to 40% to 50%. Furthermore, after reaching the equilibrium moisture with respect to a certain temperature and humidity environment, the print medium no longer absorbs moisture. However, a new portion (the portion not having reached the equilibrium moisture yet) of the print medium 2 is constantly conveyed. Thus, during printing, the above-described distribution continues constantly.

As described above, the humidity distribution of the humidification area 49 is not even in the direction of conveyance of the print medium 2 but has a gradient such that the upstream side is in a high-humidity state, whereas the downstream side is in a low-humidity state compared to the upstream side. That is, the retention of humidity in the print heads 1 is likely to be more insufficient in a more downstream area. The insufficient moisture retention may cause improper ink ejection and an increase in ink concentration.

The improper ink ejection will be described. If ink is ejected through a certain nozzle and then no ink is ejected through the nozzle for a predetermined time (for example, about 10 seconds), the following phenomenon may occur. That is, when an attempt is made to eject the next first shot of ink through the nozzle, since the viscosity of the ink has been increased by evaporation of volatile components in the ink during the ejection halt period, a phenomenon called "non-ejection" or "biased impact" may occur; in the "non-ejection", no ink is ejected, and in the "biased impact", although the non-ejection is avoided, the impact position is randomized. In the present specification, an improper ejection such as the "non-ejection" and "biased impact" which is observed a given time after the last ejection is hereinafter referred to as an "improper ejection characteristic" or simply the "improper ejection".

The present embodiment uses seven ink colors, Bk (Black), C (Cyan), M (Magenta), Y (Yellow), LC (Light Cyan), LM (Light Magenta), and Gy (Gray). Even under the same environmental temperature and humidity conditions, the level of the improper ejection characteristic varies among the ink colors depending on elements such as the concentration and type of a color material and a solvent. Furthermore, it is known that the increased level of the improper ejection characteristic reduces the speed of ink droplets (ejection speed). A method for measuring such an improper ejection characteristic involves performing a preliminary discharge in which ink not contributing to printing is ejected to refresh the vicinity of tip of each nozzle, then ejecting one ink droplet, and then allowing a high-speed camera to pick up an image of the ejection to measure an ejection speed V1 (0). After one ink droplet is ejected, the print head waits for N seconds (in the present embodiment, 6 seconds) and one ink droplet is further ejected. Then, the ejection speed V1 (N) is similarly measured.

The thus determined V1 (0) and V1 (N) are substituted into the following expression to determine ΔV.

$$\Delta V = V1(0) - V1(N)$$

When the thus determined ΔV is large, the ink has a large amount of volatile components volatilizing from the ink within a predetermined time (6 seconds), and is thus defined to have a higher level of improper ejection characteristic. The improper ejection characteristic allows the amount of volatile components in the ink evaporating within the predetermined time to be estimated.

The results of the present applicants' measurements of the improper ejection characteristic of each ink color are as described below. That is, the level of the improper ejection characteristic decreases in the order Bk (Black), M (Magenta), C (Cyan), LC (Light Cyan), LM (Light Magenta), Y (Yellow), and Gy (Gray). This means that in the above-described ink group, the Gy ink exhibits the lowest level of the improper ejection characteristic, whereas the Bk ink exhibits the highest level of the improper ejection characteristic. A major factor increasing the level of the improper ejection characteristic is evaporation of the moisture contained in the ink. Thus, at the same environmental temperature, the level of the improper ejection characteristic decreases when the humidity is high immediately below the print head and increases when the humidity is low immediately below the print head. Since the humidity distribution of the humidification area 49 is such that the humidity is high on the upstream side and low on the downstream side as described above, the level of the improper ejection characteristic is higher in a more downstream area.

FIG. 3 is a diagram showing the sequence of the colors for the print heads in the inkjet printing apparatus according to the present embodiment. Reference numerals (1*a* to 1*f*) in FIG. 3 correspond to those for the print heads in the printing unit 9 in FIG. 1, respectively. In the present embodiment, the ink tanks are arranged in the sequence Bk (Black), M (Magenta), C (Cyan), LC (Light Cyan), LM (Light Magenta), Y (Yellow), and Gy (Gray) from the upstream side in the direction of conveyance of the print medium. The purpose of this arrangement is as follows. That is, ink colors with high levels of improper ejection characteristic are arranged on the upstream side of the print head which is in the high-humidity state to suppress improper ejections such as "non-ejection" and "biased impact". Furthermore, ink colors with low levels of improper ejection characteristic are arranged on the downstream side of the print head which is in the low-humidity state to allow a sufficient ejection state to be established in spite of a low humidification effect.

From a different angle, the plurality of print heads are arranged in a sequence such that a print head configured to eject ink characterized by having a larger amount of volatile components evaporated within the predetermined time is located on an upstream area with a higher humidity. Here, the amount of volatile components evaporating from the ink within the predetermined time is estimated by allowing the ink to be ejected when a predetermined time elapses from the end of a preliminary discharge and then measuring the ejection speed of the ejected ink. Compared to the arrangement of the ink colors in a sequence from head 1*a* to head 1*f* without consideration of the improper ejection characteristic of each ink color, the arrangement of the colors in the above-described sequence enables an increase in the amount of time until the image quality is degraded in all the ink colors in connection with the improper ejection problem.

As described above, the ink colors for the print heads are arranged in a sequence corresponding to the ink characteristics. In other words, a first print head included in a plurality of print heads is provided upstream of a second print head and ejects ink characterized by having a larger amount of volatile components evaporated within a predetermined time than the second print head. Thus, the humidity in the plurality of print heads can be properly retained to suppress a possible variation in improper ejection characteristic among the print heads, without the need to increase the size or complexity of the apparatus. As a result, possible degradation of the image quality can be inhibited.

Second Embodiment

A second embodiment of the present invention will be described. The basic configuration of the present embodiment is similar to that of the first embodiment. Thus, only the characteristic configuration of the present embodiment will be described below.

First, improper printing that is a problem to be solved by the present embodiment will be described. The following phenomenon may occur if after ink is ejected through a certain nozzle, no ink is ejected through the nozzle for a given time (for example, about 2 to 3 seconds). That is, when an attempt is made to eject the next first shot of ink through the nozzle, since the concentration of ink dye has been increased near the nozzle by evaporation of the moisture contained in the ink during the ejection halt period, the first several dots during printing have an increased concentration. The term "initial concentration characteristic" as used herein refers to an increase in the concentration of the first several dots at the start of the operation as a result of the elapse of the given time from the last ejection.

The present embodiment uses seven ink colors, Bk (Black), C (Cyan), M (Magenta), Y (Yellow), LC (Light Cyan), LM (Light Magenta), and Gy (Gray). Even under the same environmental temperature and humidity conditions, the level of the initial concentration characteristic varies among the ink colors depending on elements such as the concentration and type of the color material and solvent. Furthermore, it is known that the increased level of the improper ejection characteristic reduces the speed of ink droplets (ejection speed). A method for measuring such an initial concentration characteristic involves performing a preliminary discharge to refresh the vicinity of tip of each nozzle, then allowing the print head to wait for N seconds (in the present embodiment, 6 seconds; N denotes a non-ejection time for which the level of the initial concentration characteristic is checked). Then, one shot of ink is ejected onto a print medium. A color image of the resultant dot is taken using a microscope. Thereafter, the taken color image (8 bits for each of R, G, and B) is converted into a grayscale (8 bits). The maximum signal value Smax in the dot area is measured. Then, a signal value Skami for a sheet area (unprinted area) is measured. The signal values Smax and Skami thus obtained are substituted into the following expression to determine a dot concentration (OD) and a dot concentration increase (ΔOD).

$$\text{Dot concentration}(OD) = -\log((\text{Smax}-\text{Skami})/255)$$

$$\text{Dot concentration increase}(\Delta OD) = \text{dot concentration}(N\text{ seconds}) - \text{dot concentration}(0\text{ second})$$

Figure 4:
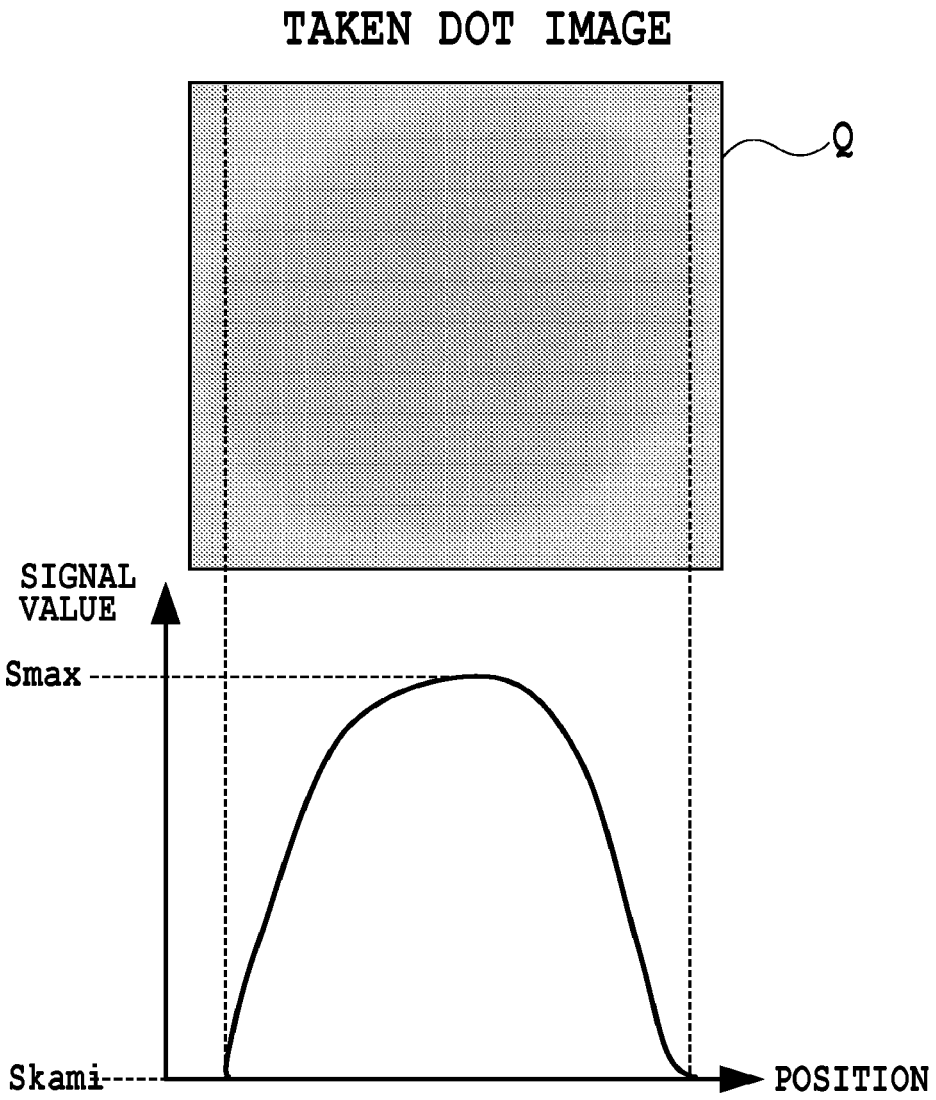
FIG. 4 is a diagram showing a dot image in comparison with a graph showing signal values.

FIG. 4 is a diagram showing a taken dot image Q and a graph showing signal values obtained when the dot image Q was measured. Based on the dot concentration increase (DOD) thus determined, ink exhibiting a larger dot concentration increase value when any non-ejection time (for example, 6 seconds) elapses is defined to have a higher level of initial concentration characteristic. The initial concentration characteristic allows estimation of the amount of volatile components in the ink which evaporate within a predetermined time.

The results of the present applicants' measurements of the initial concentration characteristic of each ink color are as described below. That is, the level of the initial concentration characteristic decreases in the order Gy (Gray), LC (Light Cyan), LM (Light Magenta), C (Cyan), M (Magenta), Y (Yellow), and Bk (Black). This means that in the above-described ink group, the black ink Bk exhibits the lowest level of the initial concentration characteristic, whereas the gray ink Gy exhibits the highest level of the initial concentration characteristic. A major factor increasing the level of the initial concentration characteristic is evaporation of the moisture contained in the ink. Thus, at the same environmental temperature, the level of the initial concentration characteristic decreases when the humidity is high immediately below the print head and increases when the humidity is low immediately below the print head. Since the humidity distribution of the humidification area 49 is such that the humidity is high on the upstream side and low on the downstream side as described above, the level of the initial concentration characteristic is higher in a more downstream area.

FIG. 5 is a diagram showing the sequence of the colors for the print heads in the inkjet printing apparatus according to the present embodiment. Reference numerals (1*a* to 1*f*) in FIG. 5 correspond to those for the print heads in the printing unit 9 in FIG. 1, respectively. In the present embodiment, the ink tanks are arranged in the sequence Gy (Gray), LC (Light Cyan), LM (Light Magenta), C (Cyan), M (Magenta), Y (Yellow), and Bk (Black) from the upstream side in the direction of conveyance of paper. The purpose of this arrangement is as follows. That is, ink colors with high levels of initial concentration characteristic are arranged on the upstream side of the print head which is in the high-humidity state to prevent an increase in the concentration of each of the ink colors with high levels of initial concentration characteristic. Furthermore, ink colors with low levels of initial concentration characteristic are arranged on the downstream side of the print head which is in the low-humidity state to allow a proper print state to be established in spite of a low humidification effect.

From a different angle, the plurality of print heads are arranged in a sequence such that a print head configured to eject ink characterized by having a larger amount of volatile components evaporated within the predetermined time is located on an upstream area with a higher humidity. Here, the amount of volatile components in the ink evaporated within the predetermined time is estimated by allowing the ink to be ejected when a predetermined time elapses from the end of a preliminary discharge and then measuring the dot concentration of the ejected ink. Compared to the arrangement of the ink colors in a sequence from head 1*a* to head 1*f* without consideration of the initial concentration characteristic of each ink color, the arrangement of the colors in the above-described sequence enables an increase in the amount of time until the image quality is degraded in all the ink colors in connection with the initial concentration characteristic.

As described above, the ink colors for the print heads are arranged in a sequence corresponding to the ink characteristics. Thus, the humidity in the plurality of print heads can be properly retained to suppress a possible variation in improper ejection characteristic among the print heads, without the need to increase the size or complexity of the apparatus. As a result, possible degradation of the image quality can be inhibited.

Third Embodiment

A third embodiment of the present invention will be described. The basic configuration of the present embodiment is similar to that of the first embodiment. Thus, only the characteristic configuration of the present embodiment will be described below.

First, a sheet-surface preliminary discharge adopted for the present embodiment will be described. The sheet-surface preliminary discharge is a method of preliminarily ejecting ink droplets onto an image already printed on a sheet at a concentration at which the ink droplets are unnoticeable to users. This method allows improper ejections to be suppressed without the need for a preliminary discharge onto any area other than an ink receiver and an image on the sheet, with proper image quality maintained. However, the preliminary discharge preferably involves a concentration at which ink droplets are unnoticeable to users. Thus, some ink colors are suitable for the sheet-surface preliminary discharge, whereas others are not.

The present embodiment uses seven ink colors, Bk (Black), C (Cyan), M (Magenta), Y (Yellow), LC (Light Cyan), LM (Light Magenta), and Gy (Gray). The results of the present applicants' examinations indicate that for ink colors including LC (Light Cyan), LM (Light Magenta), Y (Yellow), and Gy (Gray) and having a low concentration per dot, the sheet-surface preliminary discharge avoids degrading the image quality. That is, even when the sheet-surface preliminary discharge is performed at time intervals (about 0.3 seconds per nozzle) at which the improperness of images associated with the initial concentration characteristic is unnoticeable, ink dots on the sheet are unnoticeable. Thus, the image quality is prevented from being degraded. However, for ink colors including Bk (Black), C (Cyan), and M (Magenta) and having a high concentration per dot, when the sheet-surface preliminary discharge is performed at time intervals (about 0.3 seconds per nozzle) at which the improperness of images associated with the initial concentration characteristic is unnoticeable, ink dots on the sheet are noticeable. Thus, the image quality is degraded. Hence, in the present embodiment, the sheet-surface preliminary discharge is applied only to the ink colors including LC (Light Cyan), LM (Light Magenta), Y (Yellow), and Gy (Gray).

FIG. 6 is a diagram illustrating the sequence of the ink colors for the heads applied to the present embodiment. Reference numerals (1*a* to 1*f*) in FIG. 6 correspond to those for the print heads in the printing unit 9 in FIG. 1, respectively. In the present embodiment, the ink tanks are arranged in the sequence Bk (Black), M (Magenta), C (Cyan), LC (Light Cyan), LM (Light Magenta), Y (Yellow), and Gy (Gray) from the upstream side. The purpose of this arrangement is as follows. That is, ink colors not subjected to the sheet-surface preliminary discharge are arranged on the upstream side of the print head which is in the high-humidity state to prevent possible improper ejection and printing for the ink colors with a high level of improper ejection characteristic or initial concentration characteristic. Furthermore, ink colors subjected to the sheet-surface preliminary discharge are arranged on the downstream side of the print head which is in the low-humidity state to allow sufficient ejection performance to be maintained. Thus, compared to the arrangement of the ink colors in a sequence from head 1*a* to head 1*f* without consideration of the improper ejection characteristic of each ink color, the arrangement of the colors in the above-described sequence enables an increase in the amount of time until the image quality is degraded in all the ink colors in connection with the increased level of the improper ejection characteristic or initial concentration characteristic. FIG. 6 and FIG. 3 eventually show the same arrangement sequence.

As described above, the ink colors for the print heads are arranged in a sequence corresponding to the ink characteristics, and the downstream print heads are used to perform a sheet-surface preliminary discharge. In other words, a first print head included in a plurality of print heads is provided upstream of a second print head, and the second print head is more frequently subjected to a preliminary discharge onto the sheet than the first print head. Thus, all the print heads can be prevented from having the level of their improper ejection characteristic or initial concentration characteristic increased without the need to increase the size or complexity of the apparatus. As a result, possible degradation of the image quality can be inhibited.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-106618, filed May 6, 2010, which is hereby incorporated by reference herein in its entirety.

What is claimed is:

1. An inkjet printing method comprising:

conveying a sheet along a conveyance direction;

printing an image on the sheet with a plurality of print heads of an inkjet type for ink colors of black, magenta, cyan, light magenta and light cyan, the print heads being arranged along the conveyance direction;

flowing humidified air for the plurality of print heads through a space in which nozzles of the print heads are exposed downstream along the conveyance direction; and causing a first group among the plurality of print heads to perform preliminary discharge to discharge inks over an image on the sheet when printing the image, and causing a second group among the plurality of print heads other than the first group not to perform the preliminary discharge over the image when printing the image, wherein the print heads are arranged in a predetermined order such that each of the first group of the print heads is located more downstream than all of the second group of the print heads with respect to the conveyance direction.

2. The method according to claim 1, wherein the first group includes the print heads for light magenta and light cyan and the second group includes the print heads for black, magenta and cyan.

3. The method according to claim 2, wherein the print head for black is located most upstream among the print heads of the second group.

4. The method according to claim 2, wherein the plurality of the print heads further comprises print heads for ink colors of yellow and gray, each included in the first group.

5. The method according to claim 1, wherein the sheet is of a continuous type, and each of the print heads is of a line type in which the nozzles are formed to cover a maximum print width.

6. The method according to claim 5, further comprising generating the humidified with a humidifier and supplying the generated humidified air through a port located upstream of the print heads with respect to the conveyance direction.

7. The method according to claim 6, wherein the sheet is conveyed with a plurality of rollers, each located between one of the print heads and adjacent one of the print heads.

* * * * *